US011399235B1

(12) United States Patent
Miller et al.

(10) Patent No.: US 11,399,235 B1
(45) Date of Patent: Jul. 26, 2022

(54) BALANCED ARMATURE RECEIVER

(71) Applicant: Knowles Electronics, LLC, Itasca, IL (US)

(72) Inventors: Thomas Miller, Arlington Heights, IL (US); Paul C Dayton, Wayne, IL (US)

(73) Assignee: Knowles Electronics, LLC, Itasca, IL (US)

( * ) Notice: Subject to any disclaimer, the term of this patent is extended or adjusted under 35 U.S.C. 154(b) by 0 days.

(21) Appl. No.: 17/145,503

(22) Filed: Jan. 11, 2021

(51) Int. Cl.
*H04R 11/02* (2006.01)
*H04R 9/02* (2006.01)
*H04R 9/06* (2006.01)

(52) U.S. Cl.
CPC ..... *H04R 11/02* (2013.01); *H04R 9/025* (2013.01); *H04R 9/06* (2013.01); *H04R 2460/11* (2013.01)

(58) Field of Classification Search
CPC ..... H04R 9/06; H04R 9/025; H04R 11/02; H04R 2460/11
See application file for complete search history.

(56) References Cited

U.S. PATENT DOCUMENTS

| | | | | |
|---|---|---|---|---|
| 7,103,196 | B2 | 9/2006 | Warren | |
| 7,203,334 | B2 | 4/2007 | Schafer | |
| 7,302,748 | B2 | 12/2007 | Jiles | |
| 7,336,797 | B2 | 2/2008 | Thompson | |
| 7,860,264 | B2 | 12/2010 | Jiles | |
| 9,137,605 | B2 | 9/2015 | Manley | |
| 9,571,941 | B2 | 2/2017 | Heidenreich | |
| 2006/0218763 | A1 * | 10/2006 | Jiles | H04R 31/003 29/25.35 |
| 2013/0284537 | A1 | 10/2013 | LoPresti | |
| 2015/0373456 | A1 | 12/2015 | Dayton | |
| 2019/0342666 | A1 | 11/2019 | Dayton | |
| 2019/0387321 | A1 | 12/2019 | Dayton | |

FOREIGN PATENT DOCUMENTS

| | | | |
|---|---|---|---|
| CN | 204291354 | 4/2015 | |
| CN | 204350282 | 5/2015 | |
| CN | 204350283 | 5/2015 | |
| CN | 204350285 | 5/2015 | |
| CN | 204350286 | 5/2015 | |
| CN | 205830004 | 12/2016 | |
| CN | 206879077 | 1/2018 | |
| WO | WO-2018148485 A1 * | 8/2018 | H04R 7/04 |

* cited by examiner

*Primary Examiner* — Sunita Joshi
(74) *Attorney, Agent, or Firm* — Loppnow & Chapa; Matthew C. Loppnow; Roland K. Bowler, II

(57) ABSTRACT

The present disclosure relates to a balanced armature receiver (100) including a housing having a diaphragm comprising a movable paddle (116) disposed in the housing and separating the housing into a back volume (112) and a front volume (110) defined partly by space between a ceiling of the housing and the diaphragm, wherein the paddle is oriented non-parallel to the ceiling. A sound port (142) in the housing acoustically couples the front volume to an exterior of the housing, wherein the sound port is located on an end wall between the diaphragm and the ceiling. A motor disposed in the back volume includes a coil magnetically coupled to an armature having an end portion movably disposed between magnets retained by a yoke and coupled to the paddle.

24 Claims, 4 Drawing Sheets

BALANCED ARMATURE RECEIVER

TECHNICAL FIELD

This disclosure relates generally to balanced armature receivers and more specifically to balanced armature receivers having improved acoustic performance.

BACKGROUND

Balanced armature receivers (also referred to herein as "receivers" and "acoustic receivers") capable of producing sound in response to an electrical input signal are known generally. Such receivers include a diaphragm disposed in a housing and separating an interior thereof into front and back volumes. A motor located in the back volume comprises a coil disposed about an armature a portion of which is movable between permanent magnets retained by a yoke when an electrical input signal is applied to the coil. The movable portion of the armature is linked to a movable portion of a diaphragm. Movement of the diaphragm creates sound that emanates from a sound port coupled to the front volume of the housing. The sound port is typically located on an end wall of the housing, but this location limits the size of the sound port, particularly in low profile receivers. However a small sound port limits the high frequency response of the receiver. Top-port receivers can accommodate larger sound ports, but top-port receivers are not suitable for many customer applications.

BRIEF DESCRIPTION OF THE DRAWINGS

For a more complete understanding of the disclosure, reference should be made to the following detailed description and accompanying drawings wherein.

Those of ordinary skill in the art will appreciate that elements in the figures are illustrated for simplicity and clarity. It will be appreciated further that certain actions and/or steps may be described or depicted in a particular order of occurrence while those having ordinary skill in the art will understand that such specificity with respect to sequence is not actually required. It will also be understood that the terms and expressions used herein have the ordinary meaning as is accorded to such terms and expressions with respect to their corresponding respective areas of inquiry and study except where specific meanings have otherwise been set forth herein.

DETAILED DESCRIPTION

The disclosure relates generally to a balanced armature receiver comprising a diaphragm with a paddle orientated at an angle within a housing of the receiver. Such an orientation provides larger space on an end wall of the housing for the sound port, than would otherwise be available if the paddle was not orientated at an angle, without increasing the height of the receiver.

Figure 1:
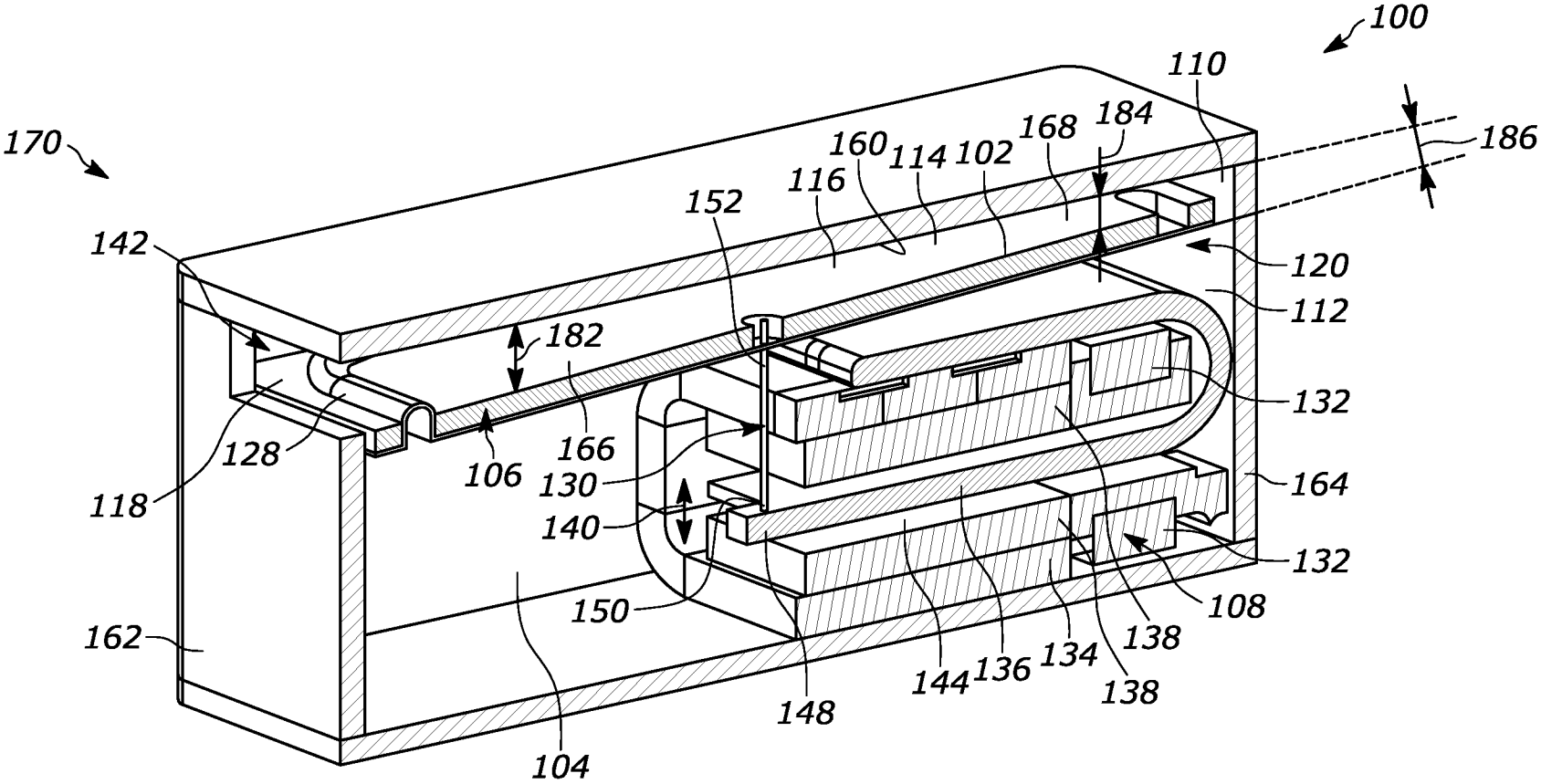
FIG. 1 is a perspective sectional view of a balanced armature receiver including a paddle oriented at an angle in the housing.

In FIG. 1, a receiver 100 comprises a housing 102 having an interior 104 containing a diaphragm 106 that separates an interior 104 of the housing into a front volume 110 and a back volume 112. A motor 108 disposed in the back volume comprises a coil 132 magnetically coupled to an armature 136 having an end portion 148 movably disposed in a space 144 between magnets 138 retained by a yoke 134. The armature 136 is coupled to a movable paddle 116 of the diaphragm, wherein the armature moves the paddle in response to an excitation signal applied to the coil.

Figure 2:
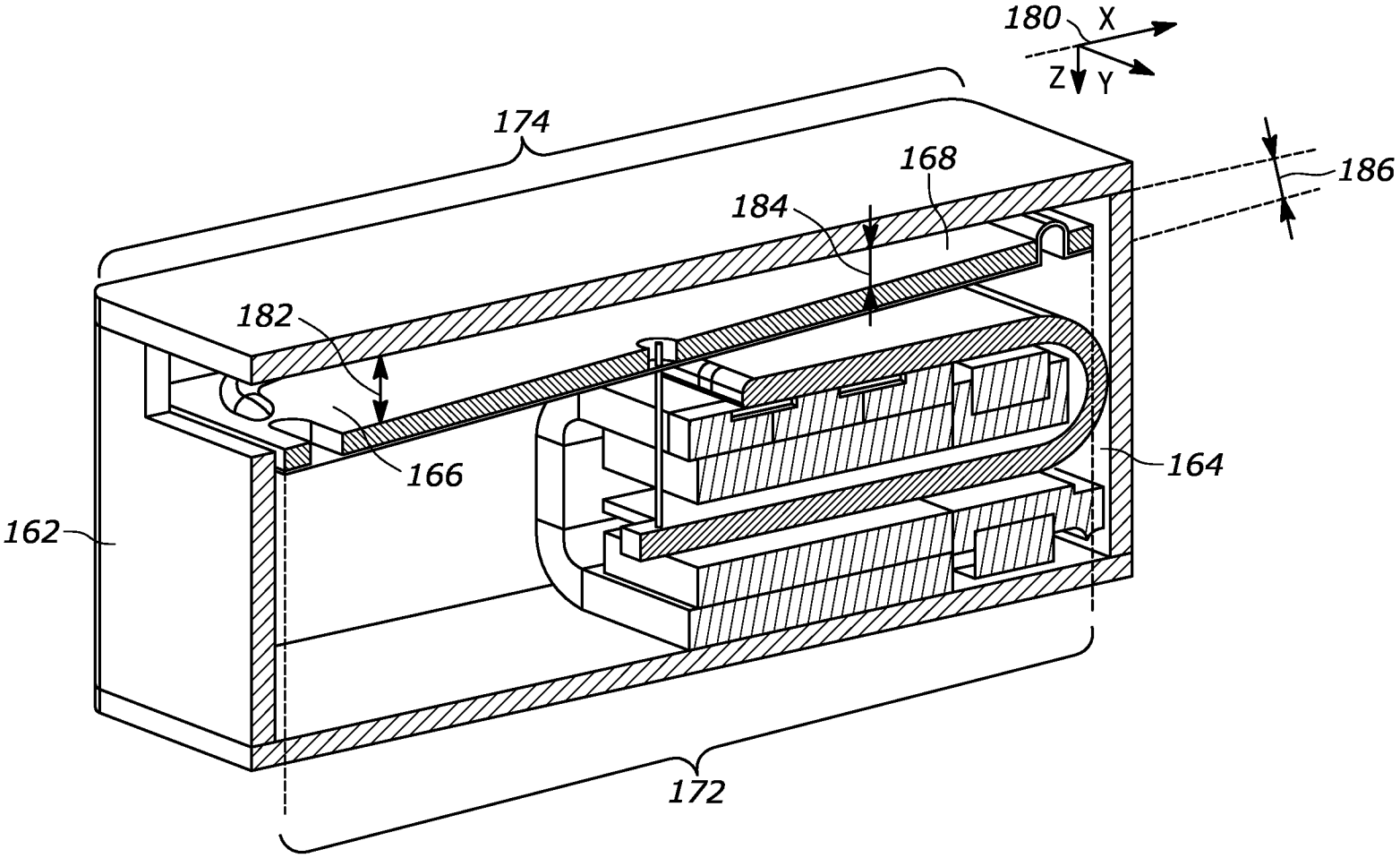
FIG. 2 is a perspective sectional view of another balanced armature receiver including a paddle oriented at an angle in the housing.
Figure 3:
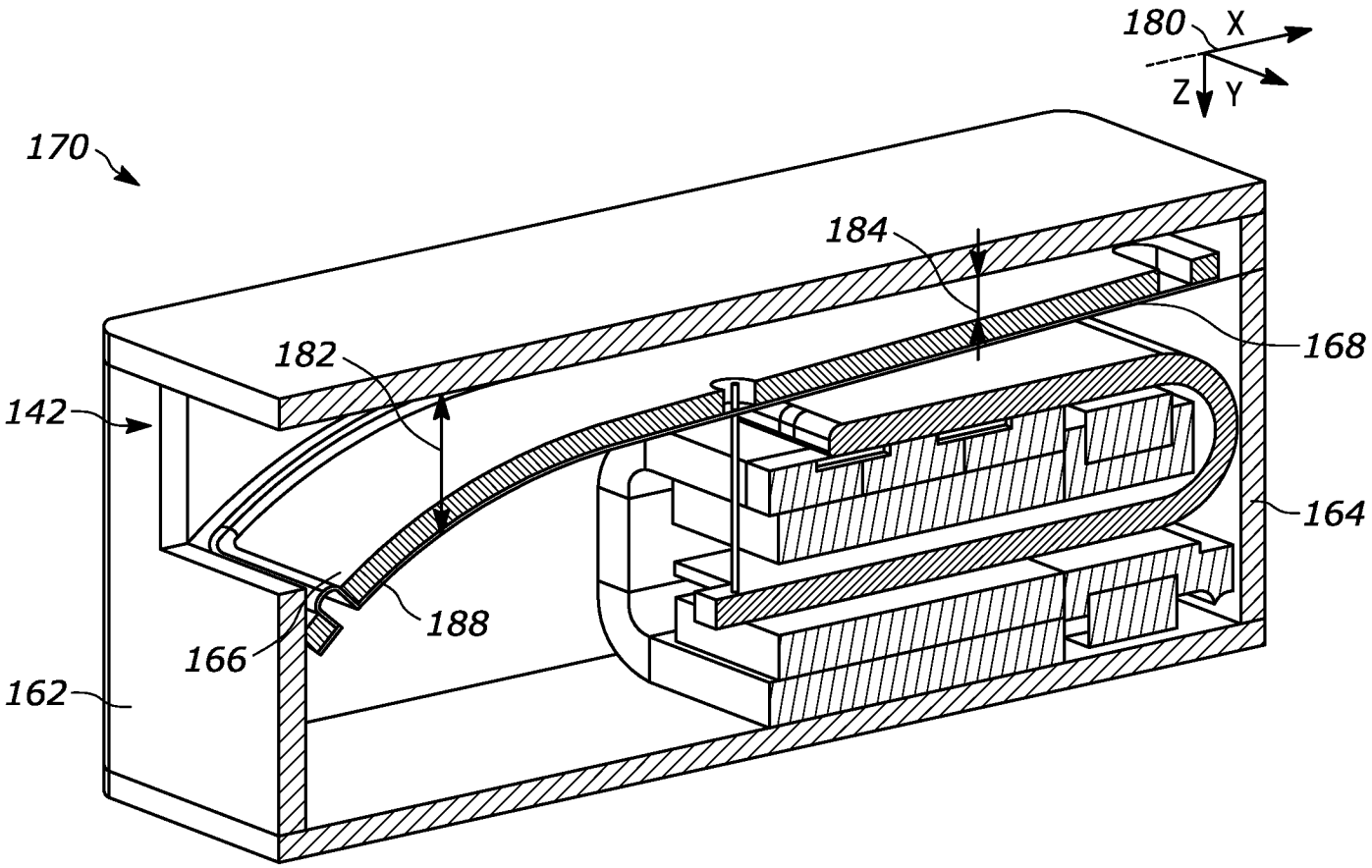
FIG. 3 is a perspective sectional view of a balanced armature receiver including a curved paddle.

In FIG. 1, the diaphragm includes a diaphragm body 114 comprising a paddle 116 flexibly coupled to a frame 118 by one or more hinges 120. A gap separates at least a portion of the paddle from the frame and the gap is covered by a membrane described further herein. In FIG. 1, the diaphragm body is an unassembled unitary member comprising the paddle, frame and hinge. In other embodiments, the diaphragm body is an assembly formed by a discrete paddle flexibly fastened to a discrete frame. Alternatively, the diaphragm is devoid of a hinge and the paddle exhibits pseudo-pistonic motion when driven by the motor. In FIGS. 2-3, the paddles are also hinged to the frame. In other implementations however the paddles in FIGS. 1-3 can be configured for pseudo-pistonic movement. In some implementations a portion of the housing constitutes the frame relative to which the paddle moves, with or without a hinge, and the gap is formed between the housing sidewall and the paddle.

The diaphragm also includes a flexible membrane bridging the gap between the paddle and the frame. The flexible membrane is configured to permit movement of the paddle relative to the frame without undue constraint. The membrane also forms an acoustic seal between the front and back volumes of the housing. An atmospheric relief vent is often formed in the diaphragm and can be formed in the membrane or paddle. In FIG. 1, the membrane 128 covers the gap between the paddle 116 and the frame 118 and has a profile that permits the paddle to move relative to the frame. In diaphragms devoid of a hinge, the membrane covers the gap between the perimeter of the paddle and the frame and permits pseudo-pistonic movement of the paddle when driven by the motor. The membrane can comprise urethane, Mylar, or a siloxane such as silicone, among other suitable materials. The flexible membrane may be applied as a layer or film disposed on an entire surface of the diaphragm body or on only select portions of the diaphragm body sufficient to cover the gap.

Figure 4:
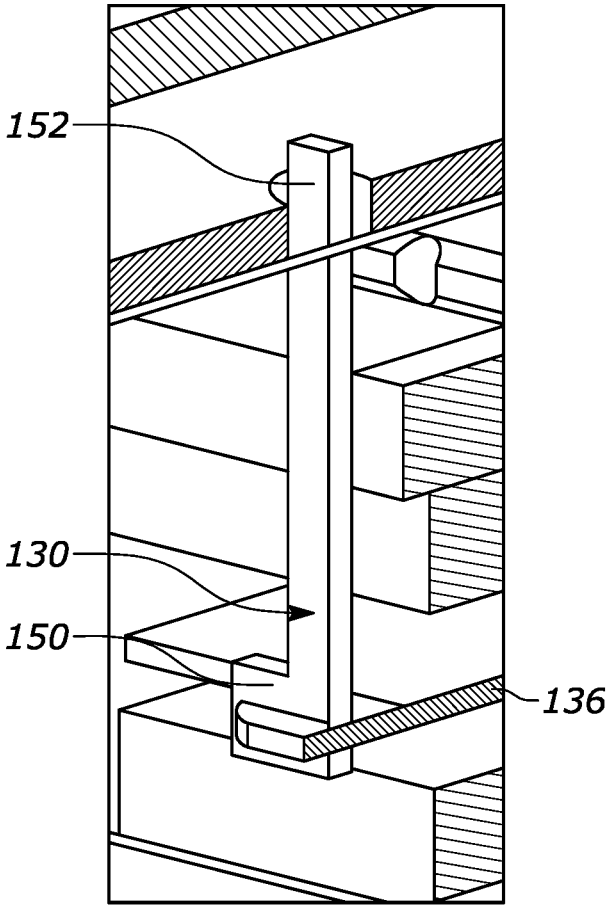
FIG. 4 is a partial perspective view of a balanced armature receiver with a ribbon linking an armature to a paddle of the receiver.

Generally, the armature is directly or indirectly coupled to the paddle. As shown in FIGS. 1-4, a linkage 130 couples the paddle to the armature 136. In FIGS. 1-3, the linkage is a drive rod having one end 150 welded, glued or otherwise fastened to an end portion 148 of the armature and a second portion 152 fastened to a glue-filled opening the paddle. The glue is not shown for clarity. In FIG. 4, the linkage 130 is a ribbon comprising a first end 150 with an aperture at least partially surrounding the end portion of the armature 136 and a second portion 152 fastened to a glue-filled opening the paddle. Alternatively, the end 152 of the drive rods in FIGS. 1-4 may be bent and fastened to an underside of the paddle by glue or another fastening mechanism. In other implementations, the armature is coupled directly to the paddle without an intermediate link.

An electric signal representing the sounds to be produced by the receiver are applied to the coil 132 which causes the armature 136 to vacillate and drive the paddle 116 in directions 140, shown in FIG. 1. The movement of the paddle 116 creates sound that emanates through a sound port 142 acoustically coupling the front volume 110 to an exterior 170 of the housing.

In FIG. 1, the receiver housing comprises a ceiling 160 between a first end wall 162 and a second end wall 164 of the housing. The front volume is defined partly by space between the ceiling 160 and the diaphragm 106. The paddle is oriented non-parallel to the ceiling, wherein a first end 166 of the paddle is proximate the first end wall 162 and a second end 168 of the paddle is proximate the second end wall 164. The sound port 142 is disposed through a portion of the end wall 162.

In FIG. 2, a major dimension 172 of the diaphragm is aligned with a major dimension 174 of the ceiling 160, and the first end wall 162 and the second end wall 164 extend along minor dimension(s) of the ceiling and diaphragm, in corresponding yz-planes shown in compass 180. In other implementations the receiver housing does not have major and minor dimensions.

In FIG. 1, a first end 166 of the paddle is spaced apart from the ceiling 160 by a first distance 182 and the second end 168 of the paddle is spaced apart from the ceiling by a second distance 184 (both along z-axes) less than the first distance. FIGS. 2-3 also show the first end 166 of the paddle spaced farther apart from the ceiling than the second end of the paddle 168. In FIGS. 1-3, the sound port is located on the end wall 162 of the receiver housing between the first end of the paddle and the ceiling. The angled orientation of the paddle relative to the ceiling provides space on the end wall 162 to accommodate a larger sound port 142, than would otherwise be available if the paddle was parallel to the ceiling. The larger sound port provides an improved frequency response, particularly at higher frequencies.

In FIGS. 1 and 2, the paddle 116 is a substantially planar member and an angle 186 between the ceiling and the paddle ranges from about 3 degrees to about 10 degrees. More generally the angle can be as high as 20 degrees or more. The specific angle for any particular receiver implementation depends on dimensional constraints and performance requirements, among other factors.

In the FIG. 3, the paddle is a non-planar member having a substantial curved or arcuate portion 188 between the first end 166 and the second end 168. A non-planar paddle having a substantial curve provides more space on the end wall of the housing, between an end of the diaphragm and the ceiling, than would otherwise be provided by a substantially planar paddle. For a given motor size, the space available on the end wall for the sound port can be increased by increasing the curvature of the paddle. As described herein, a paddle having a substantial bend or curve is a paddle having a curve greater than curves associated with features used to stiffen substantially planar paddles. Such stiffening features include ribs, so-called hats, curved edges, bump and other feature arrays formed in or on the paddle.

In one implementation, a dimension of the motor is less than a dimension of the diaphragm and the motor occupies only a portion of the back volume. Thus configured, the motor can be offset to one side of the back volume farthest away from the end portion of the paddle spaced farthest from the ceiling of the housing. Offsetting the motor in the back volume accommodates greater tilting of the paddle without increasing the height of the housing. Offsetting the motor in the back volume can also provide a mechanical advantage for actuating the paddle, depending where the armature is coupled to the paddle. In FIGS. 1-3, the motor (shown as 108 in FIG. 1) is located more near the second end wall 164 than the first end wall 162 of the housing. In one implementation, the motor occupies approximately one-half of the back volume. However, in other implementations the motor can occupy more or less of the housing back volume, depending on the size of the motor, and the desired frequency response, among other considerations. Such a construction accommodates more paddle tilt thereby permitting a larger acoustic port on the housing end wall. In other implementations the motor extends along the full length of the back volume.

In some implementations, the armature can be connected to a mid-portion of the paddle. The "mid-portion" of the paddle as used herein means within about 15 percent of the middle of the paddle. Connecting the armature to the mid-portion of the paddle may be desirable for paddles that exhibit pseudo-pistonic movement (i.e., for paddles without a hinge). Connecting the armature to the mid-portion of a hinged paddle can provide mechanical advantage since coupling the armature to the paddle more near the hinge will provide greater paddle deflection for a given armature deflection. Offsetting the motor in the back volume can provide greater flexibility on where the armature is coupled to the paddle, without the need to relocate where the link is coupled to the armature. In FIGS. 1-3, motor is offset in the back volume away from the sound port, and the link is coupled to an end portion of the armature and to a mid-portion of the paddle. In FIG. 1, the paddle is flexibly hinged to the frame opposite the sound port 142 and the end portion 148 of the armature is coupled to the mid-portion of the paddle by the drive rod 130. In FIG. 2, the paddle is flexibly hinged to the frame adjacent the sound port 142 and the end portion of the armature is coupled to the mid-portion of the paddle by the drive rod. In FIG. 2, there is a tradeoff between offsetting the motor to accommodate a larger sound port 142 and coupling the armature to the paddle in greater proximity to the hinge, since moving the motor more near the hinge may eventually interfere with the tilted paddle. In FIG. 3, the hinge for the substantially curved paddle is located opposite the sound port 142. In an alternative embodiment, the hinge for the curved paddle can be located adjacent the sound port. In another implementation, the drive link is coupled to an end of the armature and to a location on the paddle that is less than about ⅔ a distance from the hinge to the opposite end of the paddle.

The paddle can comprise conventional materials like steel or aluminum. In implementations where the diaphragm body is a unitary member, the frame and hinge comprise the same material as the paddle. Implementations where the diaphragm body is an assembly, the frame can comprise the same or different material than the paddle. In one embodiment, the frame comprises aluminum, stainless steel, nickel, copper, among other materials and combinations thereof.

While the disclosure and what is presently considered to be the best mode thereof has been described in a manner establishing possession and enabling those of ordinary skill in the art to make and use the same, it will be understood and appreciated that there are many equivalents to the select embodiments described herein and that myriad modifications and variations may be made thereto without departing from the scope and spirit of the invention, which is to be limited not by the embodiments described but by the appended claims and their equivalents.

What is claimed is:

1. A balanced armature receiver comprising:

a housing having a ceiling between a first end wall and a second end wall of the housing;

a diaphragm comprising a movable paddle coplanar with a peripheral frame and a hinge connecting the paddle to the frame, the diaphragm disposed in the housing and separating the housing into a back volume and a front volume, the front volume defined partly by space between the ceiling and the diaphragm, the paddle oriented non-parallel to the ceiling, a first end of the paddle proximate the first end wall, and a second end of the paddle proximate the second end wall;

a sound port disposed through the housing and acoustically coupling the front volume to an exterior of the housing, the sound port located on a portion of the first end wall defining the front volume, an area of the first end wall less than an area of the ceiling; and a motor disposed in the back volume and comprising a coil magnetically coupled to an armature having an end portion movably disposed between magnets retained by a yoke, and the armature coupled to the paddle.

2. The balanced armature receiver of claim 1, wherein a major dimension of the diaphragm is aligned with a major dimension of the ceiling, and the first end wall and the second end wall extend along minor dimensions of the ceiling and diaphragm.

3. The balanced armature receiver of claim 1, wherein the first end of the paddle is spaced apart from the ceiling by a distance greater than the second end of the paddle and the sound port is located between the first end of the paddle and the ceiling.

4. The balanced armature receiver of claim 3, wherein the paddle comprises a stiffening feature.

5. The balanced armature receiver of claim 4, wherein an angle between the ceiling and the paddle ranges from about 3 degrees to about 10 degrees.

6. The balanced armature receiver of claim 3, wherein the motor is located more near the second end wall of the housing than the first end wall of the housing.

7. The balanced armature receiver of claim 6, wherein the motor occupies approximately one-half of the back volume.

8. The balanced armature receiver of claim 6 further comprising a link coupling the armature to a mid-portion of the paddle.

9. The balanced armature receiver of claim 6, wherein the paddle is hinged proximate the second end wall.

10. The balanced armature receiver of claim 6, wherein the paddle is hinged proximate the first end wall having the sound port.

11. The balanced armature receiver of claim 1, wherein the paddle is hinged proximate the first end wall having the sound port.

12. The balanced armature receiver of claim 1, wherein the frame, hinge and paddle constitute an unassembled unitary member.

13. A balanced armature receiver comprising:

a housing having a ceiling located between a first end wall and a second end wall of the housing;

a diaphragm comprising a movable paddle, the diaphragm disposed in the housing and separating the housing into a back volume and a front volume, a first end of the diaphragm proximate the first end wall and a second end of the diaphragm proximate the second end wall, the paddle oriented non-parallel to the ceiling, a first end of the paddle proximate the first end wall, and a second end of the paddle proximate the second end wall;

a sound port disposed through the housing and acoustically coupling the front volume to an exterior of the housing; and a motor disposed in the back volume and comprising a coil magnetically coupled to an armature having an end portion movably disposed between magnets retained by a yoke, and coupled to the paddle, wherein the paddle has a substantial curve between the first end of the paddle and the second end of the paddle.

14. The balanced armature receiver of claim 12, wherein the paddle is a substantially planar member.

15. The balanced armature receiver of claim 13, wherein an angle between the ceiling and the paddle ranges from about 5 degrees to about 20 degrees.

16. The balanced armature receiver of claim 13, wherein the motor is located more near the second end wall of the housing than the first end wall of the housing.

17. The balanced armature receiver of claim 16, wherein the motor occupies approximately one-half of the back volume.

18. The balanced armature receiver of claim 17, wherein the is coupled to a mid-portion of the paddle.

19. The balanced armature receiver of claim 17, wherein the paddle is hinged proximate the second end wall.

20. The balanced armature receiver of claim 17, wherein the paddle is hinged proximate the first end wall having the sound port.

21. The balanced armature receiver of claim 13, wherein the first end of the paddle is spaced apart from the ceiling by a distance greater than the second end of the paddle and the sound port is located on the first end wall between the first end of the paddle and the ceiling.

22. A balanced armature receiver comprising:

a housing having a ceiling located between a first end wall and a second end wall of the housing;

a diaphragm comprising a movable paddle, the diaphragm disposed in the housing and separating the housing into a back volume and a front volume, a first end of the diaphragm proximate the first end wall and a second end of the diaphragm proximate the second end wall, the paddle oriented non-parallel to the ceiling, a first end of the paddle proximate the first end wall, and a second end of the paddle proximate the second end wall;

a sound port disposed through the housing and acoustically coupling the front volume to an exterior of the housing; and a motor disposed in the back volume and comprising a coil magnetically coupled to an armature having an end portion movably disposed between magnets retained by a yoke, and coupled to the paddle, wherein the motor is located more near the second end wall of the housing than the first end wall of the housing.

23. The balanced armature receiver of claim 22, wherein the paddle is a substantially planar member.

24. The balanced armature receiver of claim 22, wherein the first end of the paddle is spaced apart from the ceiling by a distance greater than the second end of the paddle and the sound port is located on the first end wall between the first end of the paddle and the ceiling.

* * * * *